US005302447A

United States Patent [19]

Ogata et al.

[11] Patent Number: 5,302,447

[45] Date of Patent: Apr. 12, 1994

[54] HOTMELT-ADHESIVE FIBER SHEET AND PROCESS FOR PRODUCING THE SAME

[75] Inventors: Satoshi Ogata, Moriyama; Yoshimi Tsujiyama, Moriya, both of Japan

[73] Assignee: Chisso Corporation, Ohsaka, Japan

[21] Appl. No.: 918,437

[22] Filed: Jul. 22, 1992

[51] Int. Cl.[5] ..... D02G 3/00

[52] U.S. Cl. ..... 428/288; 428/296; 428/373; 428/401

[58] Field of Search ..... 428/373, 296, 288, 401

[56] References Cited

U.S. PATENT DOCUMENTS 4,789,592 12/1988 Taniguchi et al. ..... 428/373

FOREIGN PATENT DOCUMENTS 3-287875 12/1991 Japan .
287875 12/1991 Japan .
4-11060 1/1992 Japan .
146300 5/1992 Japan .

OTHER PUBLICATIONS

Translation of JP 04-146300; "Laminated Paper"; Den et al.
Translation of JP 03-287875; "A Thermoadhesive Composite Fiber and Method of Manufacturing Said Fiber"; Taniguchi et al.
Translation of JP 04-11060; "Hydrophilic Polyolefin Unwoven Cloth"; Sakurai et al.

*Primary Examiner*—George F. Lesmes
*Assistant Examiner*—Terrel Morris
*Attorney, Agent, or Firm*—Fay, Sharpe, Beall, Fagan, Minnich & McKee

[57] ABSTRACT

A hotmelt-adhesive fiber sheet having a high adhesion onto paper, clothes ,timbers, metals, etc. is obtained by subjecting (1) a termpolymer of ethylene-acrylic acid ester-maleic anhydride, from which microfine fibers have not so far been obtained due to inferior spinnability since the terpolymer has a high frictional force against metals and is liable to generate static electricity, and (2) a thermoplastic resin having a melting point higher by 30° C. or more than the melting point of the terpolymer, to conjugate spinning according to a melt blown process, followed by making up the conjugate fibers into a web without using any spinning oiling agent and heat-treating the web.

4 Claims, No Drawings

HOTMELT-ADHESIVE FIBER SHEET AND PROCESS FOR PRODUCING THE SAME

BACKGROUND OF THE INVENTION

1. Field of the Invention

This invention relates to a hotmelt-adhesive fiber sheet and a process for producing the same. More particularly, it relates to a hotmelt-adhesive fiber sheet capable of being tightly adhered by heating on paper, clothes, timbers, metals, etc.

2. Description of the Related Art

Heretofore, as hotmelt-adhesive conjugate fibers or non-woven fabrics using the same, there have been known those obtained by subjecting polypropylene or polyester as a higher melting component and polyethylene or ethylene-vinyl acetate copolymer as a lower melting component, to conjugate spinning to obtain a web, followed by heat-treating the resulting web to fix the contact points of the fibers by melt-adhesion (see Japanese patent publication No. Sho 54-44773 and Japanese patent application laid-open No. Hei 2-49351).

However, while such conjugate fibers have a high adhesion with one another to give a non-woven fabric having a high tenacity, they have a low adhesion strength onto other materials such as paper, clothes, timbers, metals, etc., so that they have been insufficient as a raw material for composite materials. Further, there have been also known fibers using a copolymer of ethylene and an unsaturated carboxylic acid as a lower melting component of conjugate fibers, in order to improve the adhesion (see Japanese patent application laid-open No. Hei 1-92415), but such fibers have been also unsatisfactory.

As conjugate fibers having a high adhesion onto other materials, there have been known those obtained by blending a terpolymer of ethylene, acrylic acid ester and maleic anhydride into a lower melting component (see Japanese patent application laid-open No. Hei 3-133625, Japanese patent application laid-open No. Hei 3-287875 and Japanese patent application laid-open No. Hei 4-146300). In order to give a sufficient adhesion to these fibers, it is necessary to blend at least 15% by weight of such a terpolymer into a lower melting component.

However, terpolymers have a higher frictional force against metals and hence static electricity is liable to occur, resulting in an inferior spinnability so that fibers having a small fineness of 10 μm or less is difficult to obtain. Thus, there have been raised many troubles such as winding of yarns around rollers at a drawing step or occurrence of naps at a carding step, etc. In order to overcome the above problems, it has been attempted to attach a surfactant to the fibers in a quantity as large as 0.15% by weight or more, but to the contrary, the adhesion of fibers has been lowered.

SUMMARY OF THE INVENTION

The object of the present invention is to provide a hotmelt-adhesive fiber sheet, having overcome the above-mentioned drawbacks of conventional hotmelt-adhesive fibers nd sheet, having a small fineness of fibers and a high adhesion of fibers onto other materials, and a simple process for producing the same.

The present inventors have made extensive research in achieving the above-mentioned object, and found that the object can be achieved by spinning conjugate fibers using a specified terpolymer of ethylene-acrylic acid ester-maleic anhydride as a lower-melting component according to melt blown process, to obtain a web, followed by heat-treating the resulting web, and have completed the present invention.

The present invention has the following two embodiments:

(1) a hotmelt-adhesive fiber sheet composed of conjugate fibers consisting of as a first component, a mixture of 20% by weight or more of a terpolymer of ethylene, acrylic acid ester and maleic anhydride, with 80% by weight or less of a polyolefin, the content of maleic anhydride in said mixture being 0.7% by weight or more, and as a second component, a thermoplastic resin having a melting point higher by 30° C. or more than that of said first component, said first component being formed continuously in the fiber length direction so as to occupy at least a part of the surface of said fibers, and the average fiber diameter being 10 μm or less, and the contact points of said conjugate fibers being fixed with the melt adhesion of said terpolymer; and (2) a process for producing a hotmelt adhesive fiber sheet, comprising subjecting a mixture of as a first component, 20% by weight or more of a terpolymer of ethylene, acrylic acid ester and maleic anhydride, with 80% by weight or less of a polyolefin, the content of maleic anhydride in said mixture being 0.7% by weight or more, and as a second component, a thermoplastic resin having a melting point higher by 30° C. or more than that of said first component, to conjugate melt blown spinning so that said first component can be formed continuously in the fiber length direction so as to occupy at least a part of the surface of said fibers to obtain a conjugate fiber web, followed by heat-treating the resulting web at a temperature of the melting point of said terpolymer or higher and lower than that of said second component.

DETAILED DESCRIPTION OF PREFERRED EMBODIMENTS

The present invention will be described in more detail. As the terpolymer used as the first component of the hotmelt-adhesive fibers of the present invention, those composed of monomers of 6 to 30% by weight of acrylic acid ester and 0.7 to 5% by weight of maleic anhydride and the balance of ethylene, and having a melting point of 60° to 110° C. and a melt flow rate at 190° C. of 2 to 300 g/10 min. are preferred, since they have a superior spinnability and adhesion, and among the acrylic acid ester, ethyl acrylate, methyl acrylate, butyl acrylate, 2-ethylhexyl acrylate, etc. are preferred.

The terpolymer can be used not only alone as the first component, but also in admixture with a polyolefin. As such a polyolefin, high density polyethylene, low density polyethylene, linear low density polyethylene, polypropylene, etc. may be exemplified. Polyesters, polyamides, etc. other than the above polyolefins are undesirable, since they are inferior in the compatibility with the above terpolymer and inferior in the spinnability, so that it is impossible to make the fiber fineness smaller. When the terpolymer is used in admixture with a polyolefin, the content of the terpolymer in the first component should be 20% by weight or more and that of maleic anhydride in the mixture should be 0.7% by weight or more. If the content of the terpolymer in the first component and the content of maleic anhydride do not satisfy the above respective ranges, the adhesion of the resulting hotmelt-adhesive fibers is insufficient.

The content of maleic anhydride referred to herein means a proportion of maleic anhydride in the first component. For example, when the terpolymer consists of ethylene, ethyl acrylate and maleic anhydride (ethyl acrylate: 19.5% by weight, maleic anhydride: 2.5% by weight), the content of maleic anhydride is 1.25% by weight in the case where the content of the terpolymer in the first component is 50% by weight.

As the second component of the hotmelt-adhesive fibers of the present invention, a thermoplastic resin having a melting point higher by 30° C. or more than that of the first component is used. As such a thermoplastic resin, resins used for producing conventional fibers, such as polyolefins, polyesters, polyamides, etc. may be exemplified. Since the first component is inferior in the spinnability by itself, the spinnability is improved by making it conjugate with the second component. If the melting point difference between both the components is less than 30° C., even when conjugate spinning is carried out, the spinnability according to melt blown spinning process become inferior, so that it is difficult to make the fiber fineness smaller. Further, the tolerable temperature range of the heat treatment at the time of preparing the sheet from the web is narrowed. Both of these phenomena are unfavorable.

Among the thermoplastic resins as the second component, the so-called, thermal decomposition type polypropylene which molecular chain is cut by an organic peroxide or the like at the time of melt-spinning, is not only superior in the above spinnability, but also superior in making the fiber fineness smaller so that obtained web has a hard releasability from the first component; hence such a polypropylene resin is preferred.

As to the hotmelt-adhesive fiber sheet of the present invention, since the average fiber diameter of the fibers constituting the sheet is 10 μm or less; an anchor effect at the time of adhesion of the sheet onto one another or onto another material is liable to be caused. Particularly when the surface of the objective materials is rough, the anchor effect becomes notable. The average fiber diameter referred to herein means a value obtained as follows:

On a photograph of scanning electron microscope at a magnifications of 100 to 5,000, the fiber diameters at 100 points are measured, and the average value thereof are calculated.

The resulting fiber web having such an average fiber diameter of 10 μm or less can be obtained according to conjugate melt blown spinning the fibers constituting the web have a certain fiber length and are substantially unstretched.

If the average fiber diameter exceeds 10 μm, the contact area of fibers with the objective material at the time of adhesion as well as the surface area of fibers are reduced, therefore the heat quantity required for adhesion increases, moreover the anchor effect upon the objective material cannot be expected. In short, since the fibers have been substantially unstretched, the smaller the diameter of fibers constituting the sheet, the more the surface area of fibers increase, and the fibers are more liable to be bent so as to give a smaller radius of curvature. As a result, since the contact area increases, the adhesion of fibers with the objective material by the hotmelt-adhesion is improved. At the same time, since the contact area of fibers with one another increases and the number of contact points also increase, the network of fibers with one another is reinforced as well as the increase in the area of hotmelt-adhesion, to improve the retainability of sheet shape.

The hotmelt-adhesive fiber sheet of the present invention is characterized in that the contact points of fibers constituting the sheet have been hotmelt-adhered. That is, when the conjugate fiber web obtained by conjugate-melt-blown spinning is heat-treated at a temperature of the melting point or higher of the terpolymer in the first component and lower than the melting point of the second component, then the resulting conjugate fibers are fixed by melt-adhesion of the terpolymer at the contact points of the fibers while the fiber shape is retained. By fixing the conjugate fibers due to melt-adhesion, the conjugate fibers from a three-dimensional structure in the sheet so that even when the sheet is subjected to an outer pressure or force, it is hardly deformed. Thus, the obtained hotmelt-adhesive fiber sheet is superior in the shape-retainability and even when it is stacked for a long time e.g. during its storage, neither bulk-reduction nor deformation occurs. On the other hand, since the sheet is heated when it is used, the terpolymer fixing the fiber contact points by melt-adhesion is softened or melted so that the restrictive force of the three-dimensional structure is reduced to ease the movement of the fibers in the sheet or the deformation of the sheet. Thus, the contact of the fibers onto the objective material increases and the adhesion of the fibers is effectively utilized. Still further, since the hotmelt-adhesive fiber sheet of the present invention is composed of fibers of 10 μm or less, far smaller than the fineness of fibers obtained according to conventional spinning and drawing, as described above, the fibers themselves are soft and have a large number of fiber contact points, so that the fiber shape-retainability at the time of stacking the sheets and the easiness of deformation at the time of its use are achieved to improve the adhesion of the sheet of the present invention.

The conjugate melt blown spinning process refers to a process, as disclosed in Japanese patent application laid-open No. Sho 60-99057, that two kinds of thermoplastic resins each independently melted are fed into a spinneret and combined together, followed by extrudating and drawing the melted strands from spinning nozzles by blowing a high temperature gas with a high rate, and stacking the resulting fibers in the form of a sheet on a collecting conveyer. As a conjugate type, either side-by-side type or sheath-and-core type may be employed depending upon its applications, but it is preferred that the first component to be continuously formed on the fiber surface at least a portion of the fiber surface, and coats as broadly as possible.

The first component and the second component are subjected to conjugate spinning according to a melt blown process, in a conjugate ratio within a range of 80/20 to 40/60, preferably 70/30 to 50/50 by weight. If the conjugate ratio of the first component is less than 40/60, the adhesion of the resulting fibers is insufficient, while if the ratio exceeds 80/20, the spinnability lowers causing the fibers become powder form or the static electricity is liable to occur.

As the blowing gas for the conjugate melt blown spinning, air or nitrogen gas under 200 to 300 kPa and at about 400° C. is employed. The gas is ejected at a velocity of 350 to 500 m/sec at the hole of the spinnerette. The distance between the spinneret and the collecting conveyer may be set within a range of 30 to 80 cm.

In the production of the hotmelt-adhesive fiber sheet of the present invention, the first component is continuously formed so as to occupy at least a portion of the fiber surface by adjusting the conjugate ratio of the first component to the second component, the extrusion velocity and the spinning temperature.

The webs stacked on the collecting conveyer are heat-treated and processed into a sheet, by means of heat embossing rolls, heat calendering rolls, hot air-circulating drying oven, far-infrared rays heater ultrasonic welder, hot air through over, etc. Among these means, heat embossing rolls and heat calendering rolls are suitable for obtaining a sheet which has less unevenness of thickness and a uniform quality.

The present invention will be described in more detail by way of Examples and Comparative examples. In the examples, the tests of the average fiber diameter and peel strength employed in these examples were carried out according to the following methods:

Peel Strength

A test specimen of a hotmelt-adhesive fiber sheet was placed between two sheets of an aluminum foil (or a kraft paper) of 5 cm wide add 10 cm long, followed by contact-bonding the resulting material at 150° C., under a pressure of 3 Kg/cm$^2$ (294 kPa) and for 5 seconds by means of a heat-sealing tester having a press width of 1 cm, opening a part not contact-bonded of the aluminum foil (or kraft paper) and measuring the peel strength (g/5 cm) by means of a tensile tester, an initial gripping distance of 10 cm and a tensile speed of 10 cm/min.

Average Fiber Diameter

Fibers collected from a web on a collecting conveyer were photographed by means of a scanning electron microscope to obtain photographs of magnifications of 100 to 5,000, followed by measuring the fiber diameters at 100 points on the photographs and calculating the average value thereof.

In the examples, the following raw materials were used:

EH-1: ethylene-ethyl acrylate-maleic anhydride terpolymer (ethyl acrylate: 19.5% by weight, maleic anhydride: 2.5% by weight, melt flow rate: 20, m.p.: 80° C.)

EH-2: ethylene-ethyl acrylate-maleic anhydride terpolymer (ethyl acrylate 29.4% by weight, maleic anydride: 2.5% by weight, melt flow rate: 40, m.p.: 68° C.)

PE-1: high density polyethylene (melt flow rate: 93, m.p.: 129° C.)

PE-2: linear low density polyethylene (melt flow rate: 124, m.p.: 122° C.)

PP-1: polypropylene (melt flow rate: 80, m.p.: 162° C.)

PET-1: polyethylene terephthalate (intrinsic viscosity ($\eta$): 0.62, m.p.: 255° C.)

EXAMPLE 1

Using a conjugate spinneret of sheath-and-core type for melt blowing, having a nozzle diameter of 0.3 mm and having 501 spinning nozzles arranged in a row, a mixture of EH-1 with PE-1 in a weight ratio of 30/70 as a first component was fed at a spinning temperature of 260° C. and PP-1 as a second component was fed at a spinning temperature of 280° C., the conjugate ratio of the two components being 50/50 by weight, and the total extruded rate of 120 g/min., followed by blowing air at 350° C. and under 216 kPa to the polymer extruded from the spinning nozzles onto a collecting conveyer. As the collecting conveyer, a polyester net conveyer provided at a distance of 48 cm apart from the spinning nozzles and moving at a speed of 4 m/min. was used. The blown air was removed by a suction means provided on the back side of the conveyer. The resulting web was then treated by heat embossing rollers at 120° C. to obtain a sheet of very fine conjugate fibers having a basis weight of 35 g/cm$^2$.

The production conditions and the average fiber diameter of this sheet and the peel strength of the resulting sheet are shown in Table 1.

EXAMPLES 2 TO 4 AND COMPARATIVE EXAMPLE 1

Various kinds of sheets were obtained under the same conditions as in Example 1 except that the mixing proportion of EH-1 and PE-1 in the first component was varied. The production conditions and the average fiber diameters of these sheets and the peel strengths of the resulting sheets are shown together in Table 1.

EXAMPLE 5

A sheet was obtained under the same conditions as in Example 3 except that the conjugate type was changed to a side-by-side one. The production conditions and the average fiber diameter of this sheet and the peel strength of the resulting sheet are shown together in Table 1.

EXAMPLES 6 AND 7 AND COMPARATIVE EXAMPLE 2

Various kinds of sheets were obtained under the same conditions as in Example 1 except that the raw materials of the first component and the second component were varied as shown in Table 1. The production conditions and the average fiber diameters of these sheets and the peel strengths of the resulting sheets are shown together in Table 1.

COMPARATIVE EXAMPLE 3

Using the same materials as in Example 1and according to conventional conjugate spinning process in place of melt blown process, unstretched yarns having a single fiber fineness of 10.2 denier (11.2 d tex) were obtained. The yarns were drawn to 3.4 times the original length at a drawing temperature of 50° C., followed by imparting 13 crimps/25 mm and cutting to obtain staple fibers of 3 d/f (3.3 d tex, fiber diameter: 22 microns)×51 mm. The staple fibers were carded into a web, followed by treating the web by means of heat embossing rollers at 120° C. to obtain a sheet of conjugate fibers having a basis weight of 33 g/m$^2$. The fibers were attached with 0.2% by weight of an oiling agent (a surfactant), but twining of the fibers around a needle cloth was observed to a considerable extent in the carding process. The peel strength of this sheet was as low as 0.31 Kg/5 cm in the case of using an aluminum foil and 0.34 Kg/5 cm in the case of using a kraft paper, and even when the heat-sealing time was extended to 60 seconds (12 times as long as the above case), the respective peel strengths were only 1.0 Kg/5 cm and 2.0 Kg/5 cm. The production conditions and the average fiber diameter of this sheet and the peel strength of the resulting sheet are shown together in Table 1.

TABLE 1

| | First component | | | | | Second component | | Conjugate type | Conjugate ratio | Fiber diameter μm | Peel strength kg/5 cm | |
|---|---|---|---|---|---|---|---|---|---|---|---|---|
| | Terpolymer | | Other resins | | MAH Proportion | | | | | | Al foil | Kraft paper |
| | Kind | wt % | Kind | wt % | wt % | Kind | wt % | | | | | |
| Com. ex. 1 | EH-1 | 20 | PE-1 | 80 | 0.50 | PP-1 | 100 | Sheath-core | 50/50 | 4.5 | 0.98 | 1.01 |
| Example 1 | EH-1 | 30 | PE-1 | 70 | 0.75 | PP-1 | 100 | Sheath-core | 50/50 | 4.2 | 1.71 | 9.94 |
| Example 2 | EH-1 | 50 | PE-1 | 50 | 1.25 | PP-1 | 100 | Sheath-core | 50/50 | 4.1 | 2.18 | 2.38 |
| Example 3 | EH-1 | 70 | PE-1 | 30 | 1.75 | PP-1 | 100 | Sheath-core | 50/50 | 4.0 | 2.56 | 2.87 |
| Example 4 | EH-1 | 100 | None | 0 | 2.50 | PP-1 | 100 | Sheath-core | 50/50 | 4.0 | >3.4 | 2.75 |
| Example 5 | EH-1 | 70 | PE-1 | 30 | 1.75 | PP-1 | 100 | side-by-side | 50/50 | 4.2 | 2.46 | 2.62 |
| Example 6 | EH-1 | 70 | PE-2 | 30 | 1.75 | PP-1 | 100 | Sheath-core | 50/50 | 3.2 | >3.4 | 2.62 |
| Com. ex. 2 | None | — | PE-1 | 100 | 0.0 | PP-1 | 100 | Sheath-core | 50/50 | 5.0 | 0.37 | 0.79 |
| Example 7 | EH-2 | 50 | PE-1 | 50 | 1.25 | PET | 100 | Sheath-core | 50/50 | 3.5 | 1.85 | 2.04 |
| Com. ex. 3 | EH-1 | 30 | PE-1 | 70 | 0.75 | PP-1 | 100 | Sheath-core | 50/50 | 22 | 0.31 | 0.34 |

MAH proportion: maleic anhydride proportion
*The peel strength (Al foil) of Examples 4 & 6: Al foil was broken under 3.46 Kg/5 cm.

According to the present invention, by combining a terpolymer of ethylene-acrylic acid ester-maleic anhydride as a first component, having an inferior spinnability, with a second component having a melting point higher by 30° C. or more than that of the first component and subjecting them to conjugate-spinning according to a melt blown process, it has become possible to obtain a hotmelt-adhesive fiber sheet consisting of microfine fibers having an average fiber diameter of 10 μm or less. Since this hotmelt-adhesive fiber sheet comprises fibers of a small diameter as described above, it has a superior fitness onto objective materials to contribute to improvement in the adhesion. Further, due to the anchor effect upon materials to be adhered, brought about by the small fiber diameter, it is possible to improve the adhesion more than that brought about by the affinity or compatibility of the resins constituting the hotmelt-adhesive fiber sheet with the materials to be adhered. Thus, even the sheet having a small basis weight has a very high adhesion strength, and in particular, since the sheet is tightly hotmelt-adhered onto metals, paper, clothes, timbers, etc. as well as aluminum foil or kraft paper, it is useful as a sheet-form hotmelt-adhesive.

Still further, by obtaining the hotmelt-adhesive fiber sheet according to a melt blown process, it is possible to prevent reduction in the hotmelt-adhesive ability due to surfactants, etc. so far added at the conventional drawing step. Thus, it has become possible to utilize the adhesion of the resins themselves constituting the fibers effectively.

What we claim is:

1. A hotmelt-adhesive fiber sheet composed of melt blown conjugate fibers consisting of as a first component, a mixture of 20% by weight or more of a terpolymer of ethylene, acrylic acid ester and maleic anhydride, with 80% by weight or less of a polyolefin, the content of maleic anhydride in said mixture being 0.7% by weight or more, and as a second component, a thermoplastic resin having a melting point higher by 30° C. or more than that of said first component, said first component being formed continuously in the fiber length direction so as to occupy at least a part of the surface of said fibers, the average fiber diameter being 10 μm or less, and the contact points of said conjugate fibers being fixed with the melt adhesion of said terpolymer.

2. A hotmelt-adhesive fiber sheet according to claim 1, wherein said polyolefin is polyethylene.

3. A process for producing a hotmelt-adhesive fiber sheet, comprising subjecting a mixture of as a first component, 20% by weight or more of a terpolymer of ethylene, acrylic acid ester and maleic anhydride, with 80% by weight or less of a polyolefin, the content of maleic anhydride in said mixture being 0.7% by weight or more, and as a second component, a thermoplastic resin having a melting point higher by 30° C. or more than that of said first component, to conjugate melt blown-spinning so that said first component can be formed continuously in the fiber length direction so as to occupy at least a part of the surface of said fibers, followed by heat-treating the resulting conjugate fiber web at a temperature of the melting point or higher of said terpolymer and lower than that of said second component.

4. A process for producing a hotmelt-adhesive fiber sheet according to claim 3, wherein said polyolefin is polyethylene.

* * * * *